United States Patent [19]

Madzgalla, Hans-Georg

[11] Patent Number: 4,688,356

[45] Date of Patent: Aug. 25, 1987

[54] HAND-OPERATED GRINDING OR POLISHING TOOL

[75] Inventor: Madzgalla, Hans-Georg, Koblenz-Kesselheim, Fed. Rep. of Germany

[73] Assignee: Feldmuehle Aktiengesellschaft, Duesseldorf, Fed. Rep. of Germany

[21] Appl. No.: 874,165

[22] PCT Filed: Sep. 14, 1985

[86] PCT No.: PCT/EP85/00470

§ 371 Date: May 12, 1986

§ 102(e) Date: May 12, 1986

[87] PCT Pub. No.: WO86/01762

PCT Pub. Date: Mar. 27, 1986

[30] Foreign Application Priority Data

Sep. 17, 1984 [DE] Fed. Rep. of Germany ... 8427392[U]

[51] Int. Cl.[4] ..... B24D 15/04

[52] U.S. Cl. ..... 51/391; 51/392; 15/233

[58] Field of Search ..... 51/358, 391, 392, 393; 15/233

[56] References Cited

U.S. PATENT DOCUMENTS

| | | | |
|---|---|---|---|
| 2,547,837 | 4/1951 | Robbins | 51/392 X |
| 3,699,729 | 10/1972 | Garvey et al. | 51/391 |
| 4,242,843 | 1/1981 | Phillips | 51/391 X |
| 4,525,959 | 7/1985 | Ziebarth et al. | 51/391 |

FOREIGN PATENT DOCUMENTS

| | | | |
|---|---|---|---|
| 830733 | 8/1938 | France | 51/391 |
| 2114028 | 8/1983 | United Kingdom | 51/391 |

*Primary Examiner*—Robert P. Olszewski
*Attorney, Agent, or Firm*—Felfe & Lynch

[57] ABSTRACT

A manual grinding or polishing tool consists of an endless grinding or polishing belt, which is tightened about a substantially flat bar-like profile having at least one limb. The limb or limbs are disposed resiliently in relation to the profile, so that the grinding or polishing belt is held under tension. The resilient material can consist of strip steel or elastomers. Between the grinding or polishing belt and the tool body a resilient intermediate layer can be disposed in the form of an endless belt.

11 Claims, 7 Drawing Figures

HAND-OPERATED GRINDING OR POLISHING TOOL

BACKGROUND OF THE INVENTION

The invention relates to a hand-operated abrasive or polishing tool having an on-stretched, endless abrasive or polishing belt.

Manual grinding and polishing tools consist of a body on which a generally foliar abrasive means, i.e., an abrasive cloth or paper, is stretched. They are widely used in the form of files or grinding blocks, the grinding block being able to consist of rubber or cork and other resilient materials. The abrasive belt holders that are in the form of a file have a flexible, wedge-shaped backing for the belt, and the abrasive or polishing belt is held by a clamp by means of a tightening screw. In all these tools it is a disadvantage that only a small portion of the abrasive material can be utilized, because it is not possible to utilize the full stroke of the abrasive file, when, for example, it is necessary to work in a hard-to-reach location. This leads to a very high consumption of abrasive material, because only fractions of the fixed lengths, which are necessary in any case, can be used and the rest has to be discarded unused.

Furthermore, in the known tools the disadvantage exists that, if the belt material has been overstretched by the work, retightening is necessary, because otherwise the belt material can catch and tear. Such retightening is difficult and time-consuming in virtually all such tools, and in many cases it can be accomplished only to a limited extent.

Other disadvantages of the known tools lie in their shape, i.e., either only one convex surface or only one planar surface is available for the grinding or polishing operation.

It has therefore been proposed in U.S. Pat. No. 2,414,036 to provide as an grinding and polishing tool a grinding block with an endless abrasive belt, this block having acute and obtuse angles around which the endless belt is passed, while a resilient pad of felt, rubber or foam rubber can be disposed between the endless belt and the block. The tightening of the abrasive belt around the grinding block can be performed by wedge elements, since the block itself is divided. It is also possible, however, to dispose intermeshing tooth elements in the interior of the grinding block, in the form of a rack, and thus to make these tooth elements snap into one another by drawing the block apart.

This proposal, which goes back to the year 1945, has been unable to succeed, because the construction of the grinding block with its tightening means, i.e., the wedges or racks, was not optimally effective. As stated above, abrasive media, i.e., grinding belts and sandpapers, elongate on a support and catch, unless they are immediately tightened. This is not possible in the grinding block of U.S. Pat. No. 2,414,036, and instead, if the tension applied by the belt to the block relaxes, the tightening means loosens and the belt wrinkles, not only on account of its own elongation due to the work it has been doing, but also because, when the tension relaxes, the tightening means itself fails. In the case of tightening by wedges, the wedges drop out of the grinding block, and in the case of tightening by racks, the racks snap apart, i.e., the grinding block itself is no longer stable and automatically falls apart.

The invention is thus addressed to the problem of creating a tool which permits complete utilization of the grinding or polishing belt, does not require complex tightening of the grinding or polishing belt, automatically keeps the grinding or polishing belt always tight, and has at least one planar and a plurality of convex working surfaces with various radiuses.

This problem is solved by a hand-operated abrasive or polishing tool having an endless grinding or polishing belt stretched on it, which has the distinctive feature that the tool consists of a substantially flat bar-shaped profile having at least one limb, in which at least one limb is disposed resiliently with respect to the profile or another limb, and the profile and all limbs are surrounded under tension by an endless abrasive or polishing belt.

On the basis of the resilient disposition of at least one limb, it is possible to place the endless abrasive or polishing belt around the hand-operated tool without the need for complex tightening procedures. Furthermore, the endless belt is tightened by the resilient force, such that the belt is always sufficiently tight, even when it has elongated in operation. The belt is held on the tool by its natural friction, but nevertheless it can be shifted with little effort longitudinally, thus assuring a 100% utilization of the belt material if the latter has been used only at portions of the tool.

The replacement of the abrasive belt is accomplished by the simple squeezing of one or both limbs. This simplicity of the operation assures that the abrasive or polishing belt will not be damaged.

One advantageous development of the invention provides for the profile to be in the form of a rounded handle resiliently adjoining a flat limb. The handle can be made of wood or also of metal or plastic. The limb adjoining it has a flat bar-shaped profile and is resiliently joined to the handle. The tool therefore has an essentially L-shaped cross section in side elevation and, after the abrasive or polishing belt is applied, it forms a triangle with rounded corners and one curved side. This convexly curved side lies in the palm of the hand in use, but it can also be used in the grinding or polishing of concave surfaces, just as the top and bottom ends of the curved handle can be used in the case of the smaller transitional radiuses. It is especially advantageous that, in this tool, one side of the triangle is formed substantially only by the stretched abrasive belt or polishing belt. The user thus is able to work curved surfaces quickly and cleanly, because pressing the tool down causes the belt, which is under spring tension, to assume the shape of parts of the workpiece without the need to set the tool to a particular radius.

Another very advantageous development of the invention provides for the profile to be in the form of a shallowly curved bow joining together two limbs. The radius of this bow is relatively long, i.e., more than 100 mm in any case. It can best be 150 to 250 mm, while on the other hand the limbs are flat, so that one convex surface and two flat surfaces are available for working.

According to one desirable embodiment of the invention the profile terminates at both ends in radiuses, the limbs extending from these radiuses. By this disposition of radiuses at the transition from the profile to the limbs, in which these radiuses are relatively small and on the order of between 1 and 6 mm, the abrasive or polishing belt is not too sharply bent, so that a clean backing of the belt is assured even in the case of coarse grits. On the other hand, the result is that the belt can be more easily shifted longitudinally. Another advantage of this embodiment is that these radiuses make it possible to work in crevices in workpieces.

Additional advantageous embodiments of the invention provide for the length of the profile between the radiuses to be greater than the total length of the limbs, and for end sections connected by curves to the limbs to extend toward the bow. Since the sum of the limb lengths is smaller than the length of the profile, it is possible to flex the limbs far inwardly in order thus to mount the abrasive or polishing belt more easily on the tool. Installing the belt is further facilitated by the fact that it is possible to grasp and pull toward one another the end sections joined by radiuses to the limbs and to press them toward one another, thereby bringing the limbs close together and thus reducing the circumference of the abrasive or polishing tool.

The entire tool consists advantageously of a resilient material. Either natural or synthetic rubber materials can be used as the resilient material. Very advantageous is the use of elastomers, e.g., polyurethane, which can equally be molded in the corresponding configuration. However, the use of glass fiber-reinforced plastic, especially polyester, has also proven practical. The shape of the tool is to be adapted in each case to the plastic that is used, so that the desired resilient action is achieved.

An especially preferred embodiment of the invention provides for the resilient material to be a steel strip. This steel strip is generally a spring steel, such as is obtainable commercially, for example, under the VDEH designation CK 53, CK 60, CK 67, MK 75 or MK 101, and in cases in which the tool comes in contact with moisture or, in some cases, acids and alkalies, alloy steels are used, such as those known commercially by the VDEH designations 67 SICR 5, 50 CRV 4, 58 CRV 4, 12 CrNi 17 7.

For a number of materials it is necessary, especially in polishing, that the tool be pressed gently and over a large surface area against the workpiece. The invention therefore provides for a resilient backing to be placed between the abrasive or polishing belt and portions of the tool. This backing can best consist of sponge rubber or foam rubber in the form of an endless belt, but it is also possible to cement the backing permanently to the profile and/or the limbs, cork having proven to be especially suitable in this case.

According to a desirable embodiment of the invention the polishing belt consists of an endless belt of felt or fabric, i.e., after replacing the abrasive belt with the polishing belt, the initially ground surface can be treated with polishing pastes.

BRIEF DESCRIPTION OF THE DRAWINGS

The invention will be described below with the aid of the drawings, wherein.

DETAILED DESCRIPTION OF THE PREFERRED EMBODIMENTS

Figure 1:
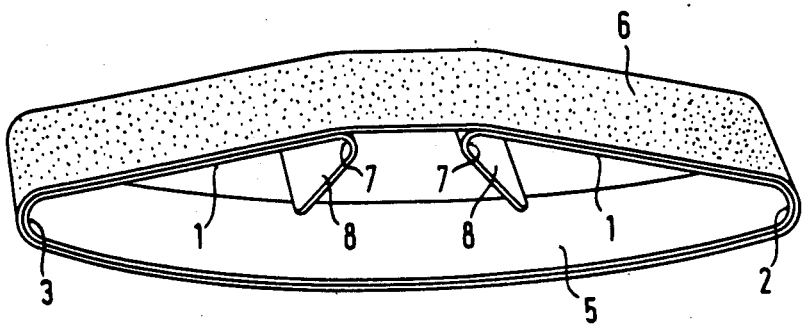
FIG. 1 is a perspective view of an abrasive tool with an endless abrasive belt mounted on it.
Figure 2:
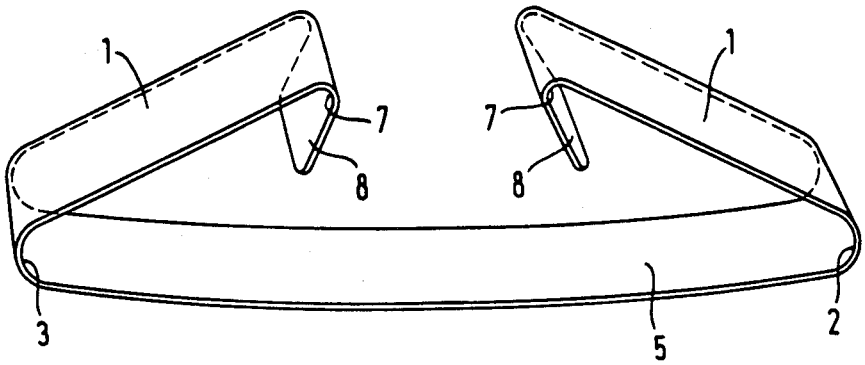
FIG. 2 shows the same tool in perspective, without an abrasive belt.
Figure 3:
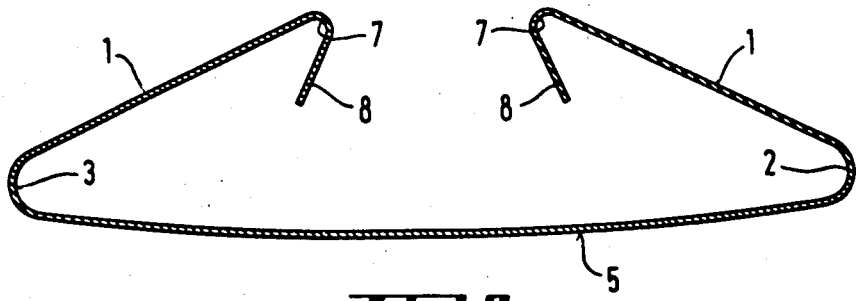
FIG. 3 is a cross section of the latter tool.
Figure 4:
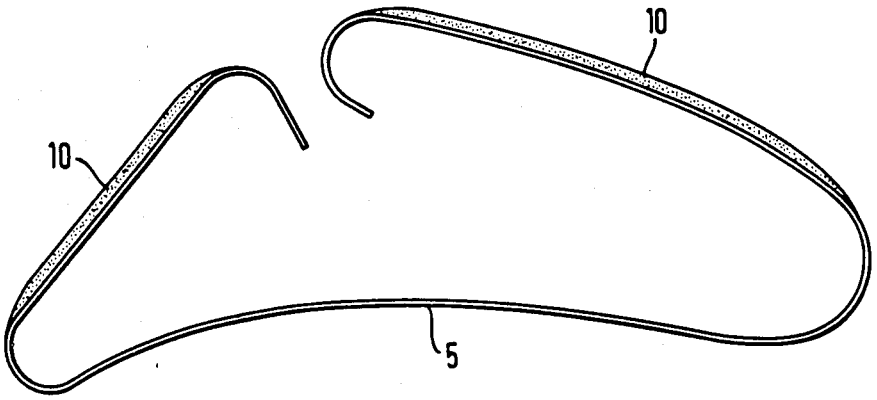
FIGS. 4 and 5 represent a slightly different geometric configuration.

In FIGS. 1 to 4, the profile attached to the limbs is formed by a bow 5, which in FIGS. 1 to 3 is in the form of a convex arc 5, and in FIG. 4 of a concave arc 5. This bow 5 is adjoined by the right radius 2 and the left radius 3. Both radiuses 2 and 3 merge with the limbs 1, which are joined by the bends 7 to the end sections 8.

If the thumb and index finger are placed one in each bend 7 and the end sections 8 are squeezed together, the bow 5 is bent and the entire circumference of the tool is reduced, so that it can be inserted into the abrasive or polishing belt 6. If pressure on the end sections 8 is then released, the material springs back and exerts a pressure on the inside surfaces of the abrasive or polishing belt which holds the belt in the given position.

In FIGS. 1 to 4 inclusive, both the bow 5 and the limbs 1 with the radiuses 2 and 3 and the curves 7 consist of a springy steel strip, i.e., the complete holder consists of one and the same material.

Figure 5:
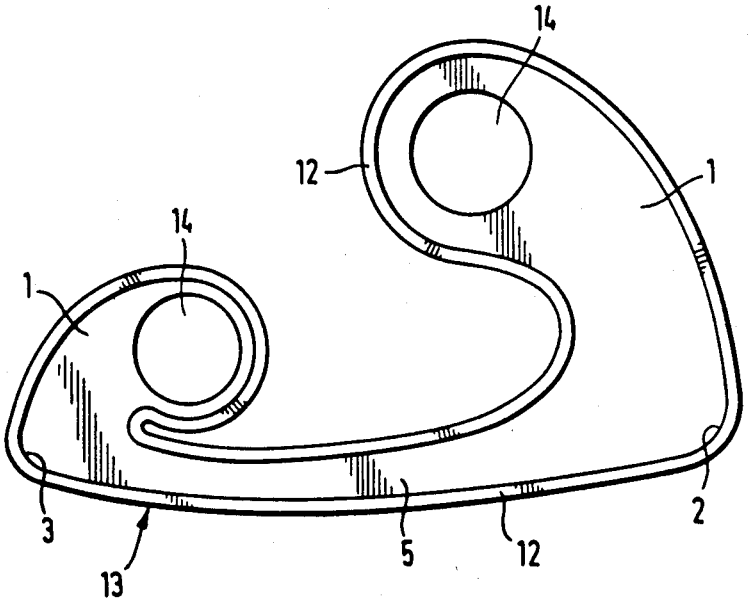

The tool shown in FIG. 5, which also consists of one and the same material, is similar. In this case, however, it is not a steel but a resilient plastic, preferably Vulcollan. A circumferential rim 12 of the width of the abrasive or polishing belt 6 surrounds the basic body 13, which has the eyes 14 which serve for contracting and thus increasing the curvature of the bow 5.

Figure 6:
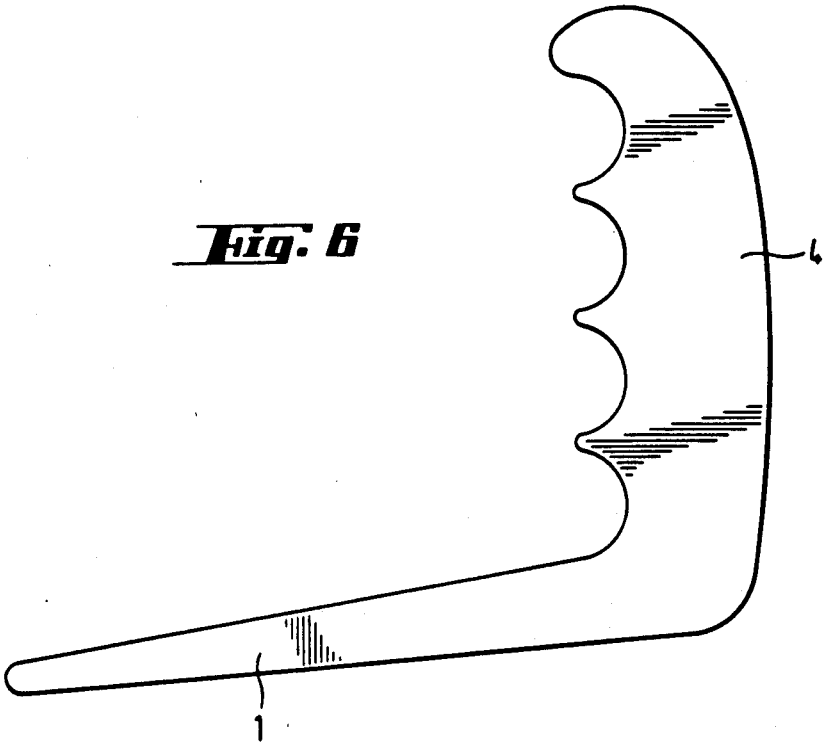
FIGS. 6 and 7 represent an embodiment of the tool having only one limb.
Figure 7:
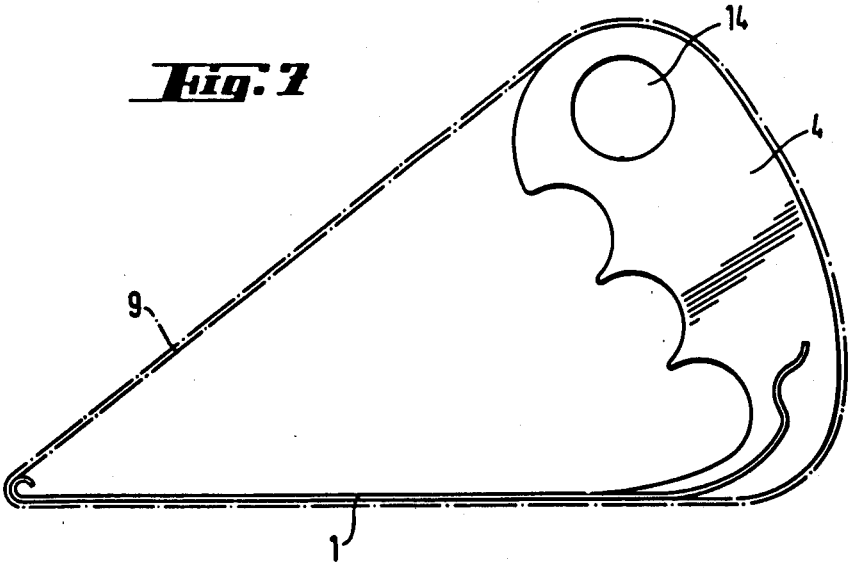

FIGS. 6 and 7 represent generally L-shaped configurations of the abrasive or polishing tool, in which the bow is formed by the handle 4, which is adjoined by a limb 1. In FIG. 6, this is a limb 1 which consists, like the handle 4, of a glass fiber reinforced polyester resin, whereas in FIG. 7 the limb 1 is a strip of steel which is embedded in a thermoplastic in the handle 4. Also represented in this figure is a foam rubber belt 9 which is disposed as a backing between the abrasive or polishing belt and the tool, and has also been made into an endless belt. This foam rubber belt 9 serves, as explained above, to permit the application of a softer pressure against the workpiece. A similar purpose is achieved, as represented in FIG. 4, with the cork backing 10 applied to the limbs 1.

I claim:

1. Hand operated abrading or polishing tool comprising an arcuate holder including a substantially flat, bar-like profile portion and two limbs, and an endless abrasive or polishing belt that is under tension encompassing the holder, the substantially flat, bar-like profile portion comprising a shallowly curved bow joining together the two limbs, which bow is defined at both ends by radii, the limbs extending from these radii in a direction towards each other, and the holder including end sections and bends joining the end sections to the limbs, the end sections extending in the direction of the bow so as to permit the squeezing together of the limbs to change belts.

2. Hand operated abrading or polishing tool according to claim 1, in which the length of the bow defined by the radii is greater than the total length of the limbs.

3. Hand operated abrading or polishing tool according to claim 1, in which the holder and the limbs comprise the same resiliently flexible material.

4. Hand operated abrading or polishing tool according to claim 3, in which the resiliently flexible material is a flat steel spring.

5. Hand operated abrading or polishing tool according to claim 3, in which the resiliently flexible material is an elastomer.

6. Hand operated abrading or polishing tool according to claim 3, in which the resiliently flexible material is a glass fiber-reinforced plastic.

7. Hand operated abrading or polishing tool according to claim 1, in which between the abrasive or polishing belt and the holder there is disposed, at least in partial areas, a resilient intermediate layer.

8. Hand operated abrading or polishing tool according to claim 7, in which the intermediate layer is a sponge or foam rubber in the form of an endless belt.

9. Hand operated abrading or polishing tool according to claim 7, in which the intermediate layer comprises cork surfaces cemented permanently to at least a portion of the holder.

10. Hand operated abrading or polishing tool according to claim 1, in which the polishing belt comprises at least one of an endless felt and fabric.

11. Hand-operated abrading or polishing tool comprising a resiliently flexible holder having a substantially flat, bar-like profile portion and two limbs extending therefrom in a direction towards each other and individually having end portions, and an endless abrasive or polishing belt that is under tension encompassing the holder, and each on the limbs including a curved portion having a finger-hole therein and so disposed at the end portion of each of the limbs as to permit the squeezing together of the limbs to change belts.

* * * * *